US008986010B2

(12) United States Patent
Lee et al.

(10) Patent No.: US 8,986,010 B2
(45) Date of Patent: Mar. 24, 2015

(54) AIRBURST SIMULATION SYSTEM AND METHOD OF SIMULATION FOR AIRBURST

(71) Applicants: Joon-Ho Lee, Chungcheongbuk-Do (KR); Je-Wook Chae, Daejeon (KR); Eui-Jung Choe, Daejeon (KR); Sung-Bae Lee, Daejeon (KR); Hyun-Jun Kim, Daejeon (KR)

(72) Inventors: Joon-Ho Lee, Chungcheongbuk-Do (KR); Je-Wook Chae, Daejeon (KR); Eui-Jung Choe, Daejeon (KR); Sung-Bae Lee, Daejeon (KR); Hyun-Jun Kim, Daejeon (KR)

(73) Assignee: Agency for Defense Development (KR)

( * ) Notice: Subject to any disclaimer, the term of this patent is extended or adjusted under 35 U.S.C. 154(b) by 145 days.

(21) Appl. No.: 13/705,794

(22) Filed: Dec. 5, 2012

(65) Prior Publication Data

US 2014/0065578 A1 Mar. 6, 2014

(30) Foreign Application Priority Data

Dec. 13, 2011 (KR) ..... 10-2011-0133673

(51) Int. Cl.

| | |
|---|---|
| ***F41G 3/26*** | (2006.01) |
| ***F41J 5/02*** | (2006.01) |
| ***F41A 33/02*** | (2006.01) |
| *F41A 19/42* | (2006.01) |

(52) U.S. Cl.

CPC ..... *F41G 3/2655* (2013.01); *F41J 5/02* (2013.01); *F41A 33/02* (2013.01); *F41G 3/2688* (2013.01); *F41A 19/42* (2013.01)

USPC ..... 434/22; 434/16

(58) Field of Classification Search

CPC ... F41G 3/2655; F41G 3/2622; F41G 3/2666; F41G 3/2661; F41G 3/2688; F41G 3/323; G09B 9/003

USPC ..... 434/22

See application file for complete search history.

(56) References Cited

U.S. PATENT DOCUMENTS

| | | | | |
|---|---|---|---|---|
| 3,907,433 | A * | 9/1975 | Nault | 356/152.1 |
| 4,340,370 | A * | 7/1982 | Marshall et al. | 434/22 |
| 4,342,556 | A * | 8/1982 | Hasse | 434/22 |

(Continued)

FOREIGN PATENT DOCUMENTS

| | | |
|---|---|---|
| DE | 10-2005-055099 | 5/2007 |
| EP | 1 890 104 | 2/2008 |

(Continued)

OTHER PUBLICATIONS

Official Action mailed Apr. 20, 2012 mailed in corresponding Korean Application No. 10-2011-0133673.

(Continued)

*Primary Examiner* — Sam Yao
*Assistant Examiner* — Thomas Hong
(74) *Attorney, Agent, or Firm* — Ostrolenk Faber LLP

(57) ABSTRACT

The present disclosure relates to an airburst simulation system and method. The airburst simulation system includes a laser emitting unit to emit laser beam to an airburst aiming position, preset above a target hidden behind an obstacle, such that a warhead is airbursted to shoot the target, a laser detecting unit mounted onto the target to detect an arrival of the laser beam above the target, and a determining unit to measure a distance between the airburst aiming position and an arrival position of the laser detected by the laser detecting unit, and determine whether or not the target has been shot based on the distance. This allows for a simulated engagement using an airburst apparatus, with no harm to human bodies by virtue of the use of laser.

14 Claims, 7 Drawing Sheets

(56) References Cited

U.S. PATENT DOCUMENTS

| | | | | |
|---|---|---|---|---|
| 4,464,115 | A * | 8/1984 | Simpson et al. | 434/27 |
| 4,488,876 | A * | 12/1984 | Thomas et al. | 434/20 |
| 4,804,325 | A * | 2/1989 | Willits et al. | 434/22 |
| 4,835,621 | A * | 5/1989 | Black | 386/358 |
| 4,955,812 | A * | 9/1990 | Hill | 434/16 |
| 5,289,993 | A * | 3/1994 | McWilliams et al. | 244/3.15 |
| 5,577,733 | A * | 11/1996 | Downing | 273/348 |
| 5,686,690 | A * | 11/1997 | Lougheed et al. | 89/41.17 |
| 5,914,661 | A * | 6/1999 | Gross | 340/600 |
| 5,929,444 | A * | 7/1999 | Leichner | 250/341.7 |
| 5,991,043 | A * | 11/1999 | Andersson et al. | 356/400 |
| 6,283,756 | B1 * | 9/2001 | Danckwerth et al. | 434/11 |
| 6,386,879 | B1 * | 5/2002 | Varshneya et al. | 434/16 |
| 6,599,127 | B1 * | 7/2003 | Hopmeier et al. | 434/16 |
| 6,616,452 | B2 * | 9/2003 | Clark et al. | 434/19 |
| 7,158,167 | B1 * | 1/2007 | Yerazunis et al. | 348/61 |
| 7,345,265 | B2 * | 3/2008 | Page | 244/3.1 |
| 2002/0064760 | A1 * | 5/2002 | Lazecki et al. | 434/11 |
| 2003/0082501 | A1 * | 5/2003 | Varshneya | 434/22 |
| 2003/0195046 | A1 * | 10/2003 | Bartsch | 463/49 |
| 2004/0219491 | A1 * | 11/2004 | Shlomo | 434/11 |
| 2007/0026364 | A1 * | 2/2007 | Jones et al. | 434/11 |
| 2007/0238073 | A1 * | 10/2007 | Portoghese et al. | 434/21 |
| 2007/0243504 | A1 * | 10/2007 | Bjorkman et al. | 434/22 |
| 2008/0160486 | A1 * | 7/2008 | Tengblad | 434/19 |
| 2009/0081619 | A1 * | 3/2009 | Miasnik | 434/21 |
| 2011/0311949 | A1 * | 12/2011 | Preston et al. | 434/16 |
| 2012/0183928 | A1 * | 7/2012 | Finlayson et al. | 434/16 |
| 2012/0183929 | A1 * | 7/2012 | Sullivan | 434/16 |
| 2012/0274922 | A1 * | 11/2012 | Hodge | 356/28 |

FOREIGN PATENT DOCUMENTS

| | | |
|---|---|---|
| GB | 2 151 871 | 7/1985 |
| JP | 2010-078212 | 4/2010 |
| JP | 2010-121838 | 6/2010 |
| KR | 10-0915857 | 9/2009 |
| KR | 10-2010-0136274 | 12/2010 |
| KR | 10-2011-0113839 | 10/2011 |
| KR | 10-1084907 | 11/2011 |
| WO | WO 2011/022426 | 2/2011 |

OTHER PUBLICATIONS

Official Action mailed Aug. 17, 2012 mailed in corresponding Korean Application No. 10-2011-0133673.

International Search Report for corresponding European Application No. EP 12 19 6085 mailed on Apr. 26, 2013.

* cited by examiner

AIRBURST SIMULATION SYSTEM AND METHOD OF SIMULATION FOR AIRBURST

CROSS-REFERENCE TO RELATED APPLICATION

Pursuant to 35 U.S.C. §119(a), this application claims the benefit of earlier filing date and right of priority to Korean Application No. 10-2011-0133673, filed on Dec. 13, 2011, the contents of which is incorporated by reference herein in its entirety.

BACKGROUND OF THE INVENTION

1. Field of the Invention

This specification relates to an airburst simulation system, an airburst simulation method, and a simulation apparatus having a dual barrel used therefor.

2. Background of the Invention

The present disclosure relates to an airburst simulation apparatus for simulating airburst of airburst ammunitions. A Multiple Integrated Laser Engagement System (MILES) as virtual engagement equipment is used world-widely for carrying out a combat training similar to an actual combat. The MILES system is an equipment which has been developed for providing realistic combat experience using properties of laser beams, such as straight propagation, data transfer, harmlessness to human bodies and the like. The MILES system includes a laser emitting unit (or laser firing unit), and a laser detecting unit. The laser detecting unit detects (senses) whether or not laser beam emitted from the laser emitting unit hits the target.

In recent time, a personal firearm having a dual barrel which allows for selective firing (shooting) of a small caliber bullet and a large caliber airburst ammunition. Here, the MILES system which senses laser beam reaching the target has a problem in that an airburst mode, in which an airburst ammunition is fired to a hidden target, is unable to be simulated.

SUMMARY OF THE INVENTION

Therefore, an aspect of the detailed description is to provide a simulation of an airburst mode using a laser.

To achieve these and other advantages and in accordance with the purpose of this specification, as embodied and broadly described herein, there is provided an airburst simulation system including a laser emitting unit, a laser detecting unit and a determining unit. The laser emitting unit may emit laser beam to an airburst aiming position, preset above a target hidden behind an obstacle, such that a warhead is airbursted to shoot the target. The laser detecting unit may be mounted onto the target to detect an arrival of the laser beam above the target. The determining unit may measure a distance between the airburst aiming position and an arrival position of the laser detected by the laser detecting unit, and determine whether or not the target has been shot based on the distance.

In one aspect of the present disclosure, the laser emitting unit may include a body and a laser emitter. The body may have a trigger. The laser emitter may be installed in the body to emit laser beam by pulling the trigger.

In one aspect of the present disclosure, the laser emitting unit may include a firing pin protruded by the trigger to press a simulated ammunition, and a pressure sensor to sense pressure applied onto the simulated ammunition, and convert the sensed pressure into a signal to transfer to the laser emitting unit.

In one aspect of the present disclosure, the laser emitting unit may further include a firing noise generator to generate noise upon emitting the laser beam.

In one aspect of the present disclosure, the laser emitting unit may include a blank cartridge fired by the trigger, and a firing impact detector to detect the firing of the blank cartridge.

In one aspect of the present disclosure, the laser emitting unit may include a Global Positioning System (GPS), and an electronic compass.

In one aspect of the present disclosure, the laser detecting unit may include first and second cameras disposed with being spaced apart from each other to photograph the laser beam, respectively, at the spaced positions, and a posture sensing unit to measure respective angles that the first and second cameras face the laser.

In one aspect of the present disclosure, the determining unit may measure the distance between the airburst aiming position and the arrival position of the detected laser, to determine whether or not the target has been shot based on the measured distance and a preset reference distance.

In one aspect of the present disclosure, the determining unit may include a display unit to output at least one of an image and a sound to indicate whether or not the target has been shot.

In one aspect of the present disclosure, when the laser emitting unit emits a plurality of laser beams, the determining unit may determine which laser beam of the plurality of laser beams has shot the target, by comparison between a time point of sensing the arrival of the laser beam and a time point of emitting the laser beam, comparison between coordinates of a position of the target and coordinates of the airburst aiming position, and comparison between a directional vector of the emitted laser beam and a directional vector of the laser beam detected by the laser detecting unit.

In one aspect of the present disclosure, the available number of laser emission by the laser emitting unit may be limited to a preset number of times, and the determining unit may determine a laser beam which is emitted after exceeding the preset number of times to be invalid.

To achieve these and other advantages and in accordance with the purpose of this specification, as embodied and broadly described herein, there is provided a simulation method for an airburst including emitting laser beam to an airburst aiming position, preset above a target hidden behind an obstacle, such that a warhead is airbursted to shoot the target, detecting the laser beam arriving above the target, and measuring a distance between the airburst aiming position and an arrival position of the laser beam, and determining whether or not the target has been shot based on the distance.

In one aspect of the present disclosure, the step of emitting the laser beam to the airburst aiming position, preset above the target hidden behind an obstacle, such that the warhead is airbursted to shoot the target may include applying pressure to a simulated ammunition by pulling a trigger, generating a signal by sensing the pressure applied to the simulated ammunition, and emitting the laser beam in response to the signal.

In one aspect of the present disclosure, the step of emitting the laser beam to the airburst aiming position may include measuring a distance from a position of emitting the laser beam to the obstacle so as to estimate a distance up to the target.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of an airburst simulation system and an airburst simulation method according to the exemplary embodiments, with reference to the accompanying drawings. For the sake of brief description with reference to the drawings, the same or equivalent components will be provided with the same reference numbers, and description thereof will not be repeated. A singular representation may include a plural representation as far as it represents a definitely different meaning from the context.

The airburst simulation system may include a laser emitting unit and a laser detecting unit. A soldier who carries out an airburst simulation test may wear at least one of the laser emitting unit and the laser detecting unit. The airburst simulation system may further include a determining unit to determine information obtained by the laser emitting unit and the laser detecting unit. Hereinafter, the laser emitting unit, the laser detecting unit and the determining unit will be described in detail.

The laser emitting unit may be implemented as an airburst simulation apparatus.

Figure 1:
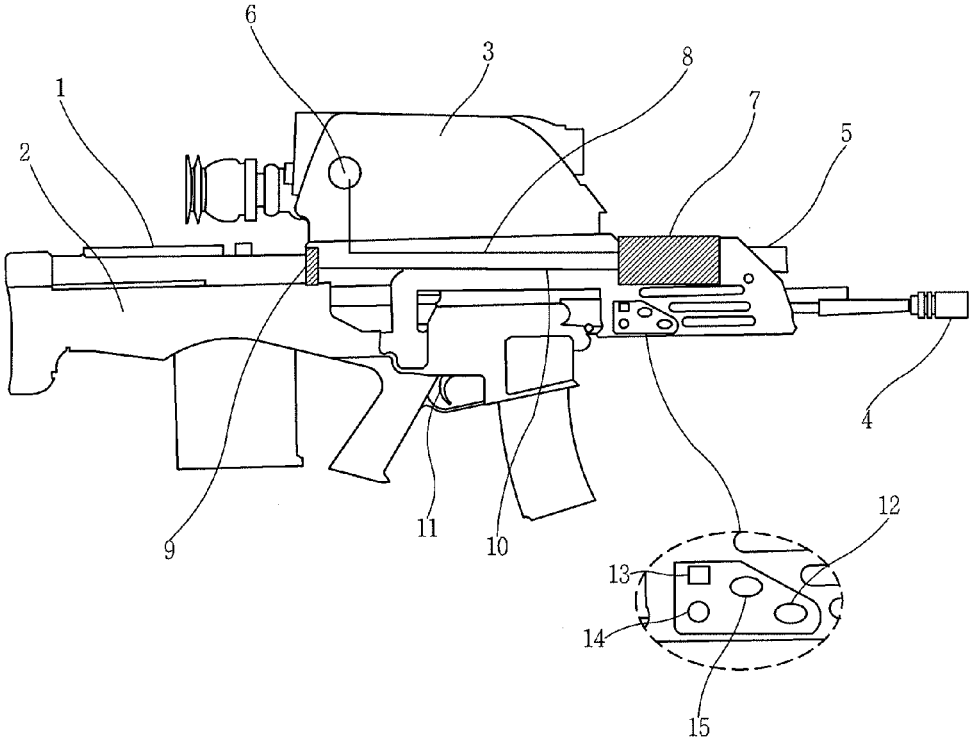
FIG. 1 is a side view of an airburst simulation apparatus having a laser emitter.
Figure 2:
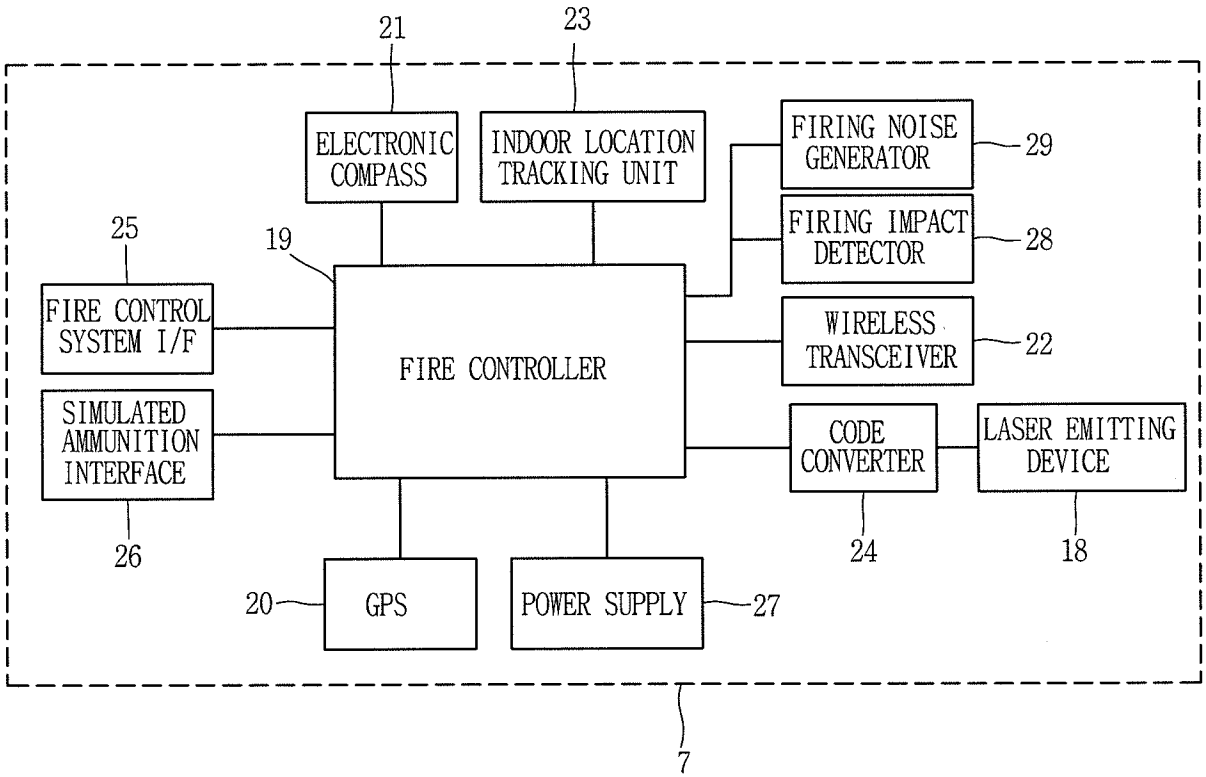
FIG. 2 is a configuration view of the laser emitter of FIG. 1.
Figure 3A:
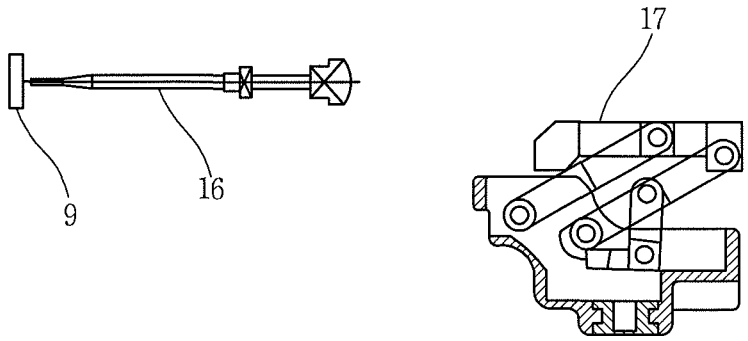
FIGS. 3A to 3C are conceptual views showing an operation of a pressure sensor which is cooperative with a simulated ammunition interface (or a dummy ammunition interface) of FIG. 2.
Figure 3B:
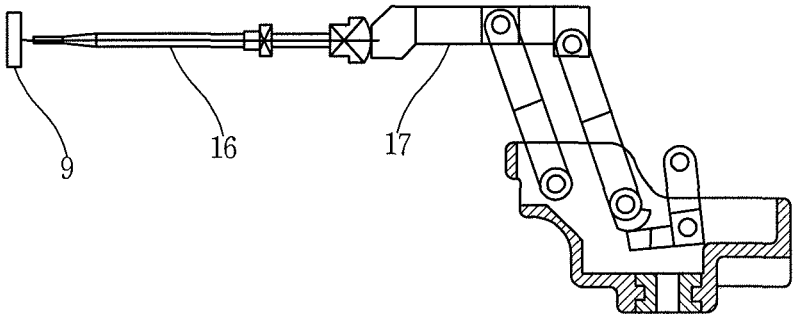
Figure 3C:
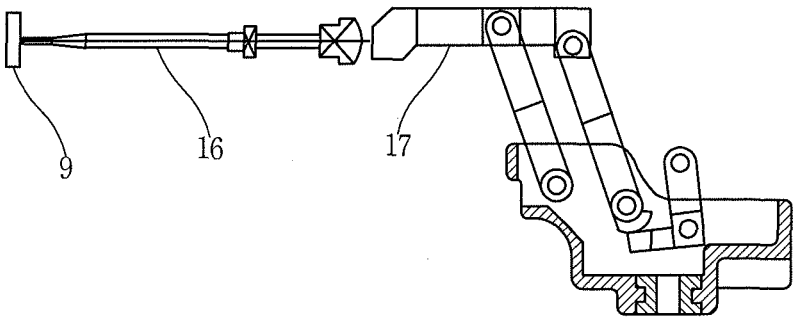
Figure 4:
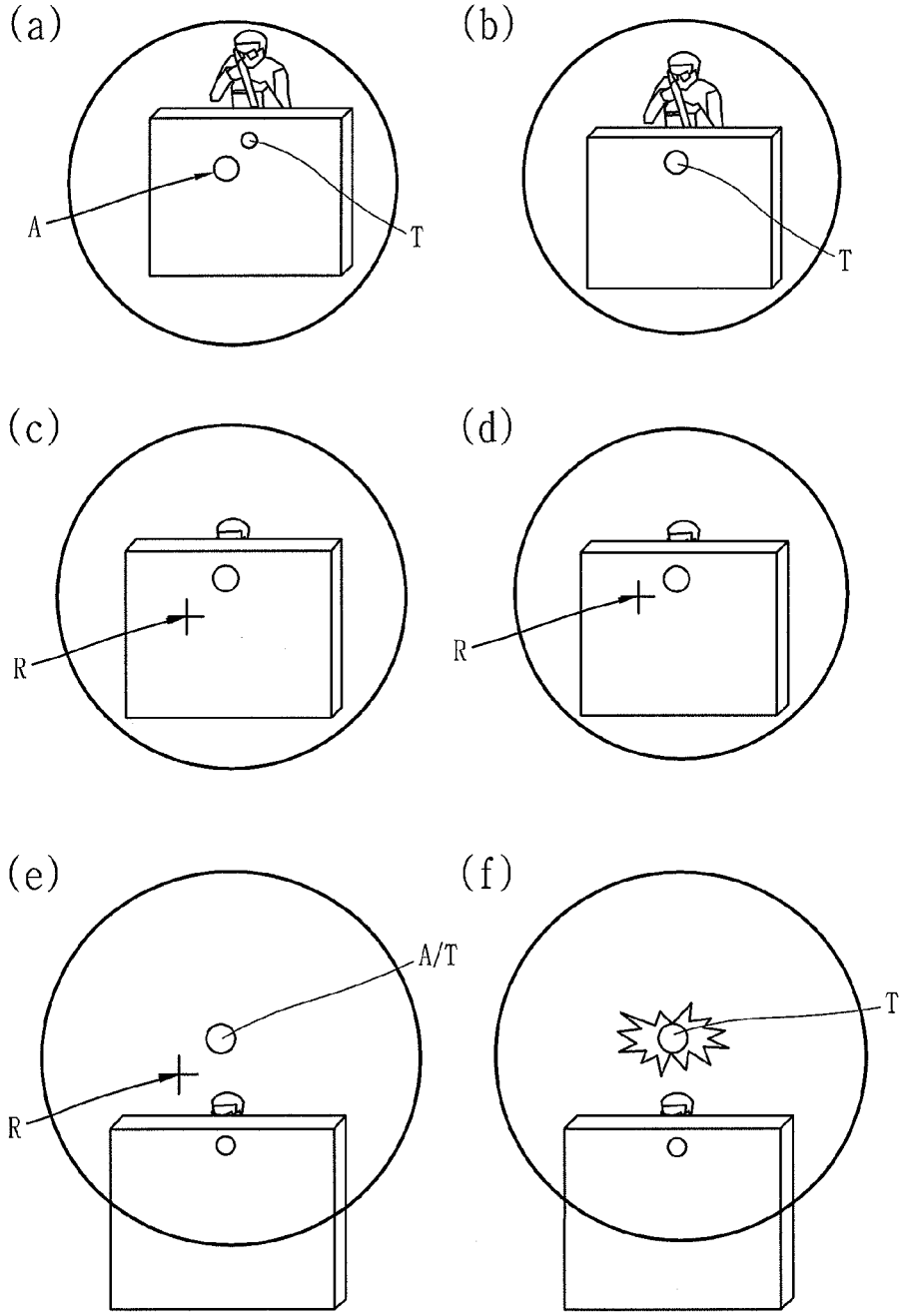
FIG. 4 is a flowchart showing sequential operation steps of a firing simulation system for an airburst using the airburst simulation apparatus.
Figure 5:
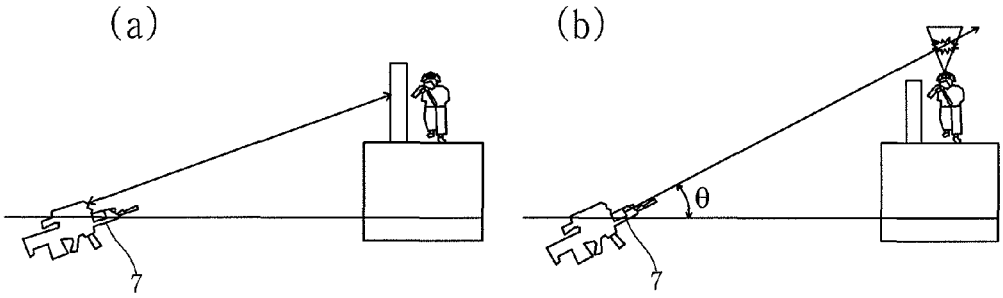
FIG. 5 is a side conceptual view showing an engagement simulation method for an airburst using the airburst simulation apparatus.
Figure 6:
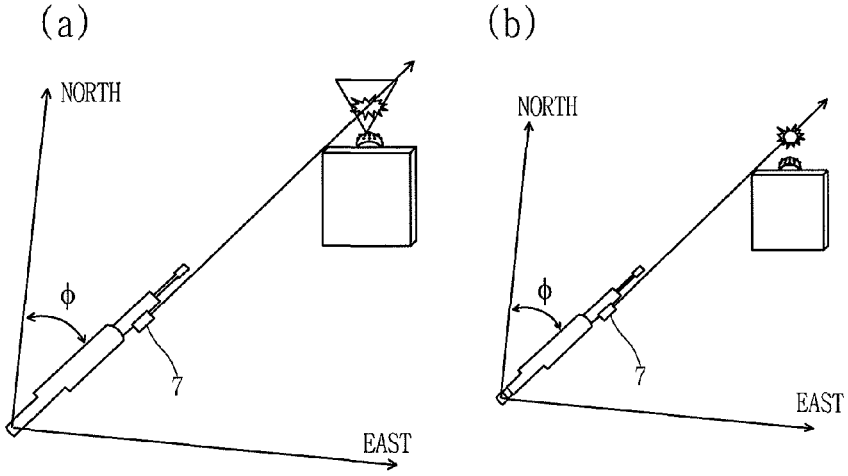
FIG. 6 is a top conceptual view showing the engagement simulation method for the airburst using the airburst simulation apparatus.

FIG. 1 is a side view of an airburst simulation apparatus having a laser emitting unit. FIG. 2 is a configuration view of the laser emitter of FIG. 1. FIGS. 3A to 3C are conceptual views showing an operation of a pressure sensor which is cooperative with a simulated ammunition interface (or a dummy ammunition interface) of FIG. 2. FIG. 4 is a flowchart showing sequential operation steps of a firing simulation system for an airburst using the airburst simulation apparatus. FIG. 5 is a side conceptual view showing an engagement simulation method for an airburst using the airburst simulation apparatus. FIG. 6 is a top conceptual view showing the engagement simulation method for the airburst using the airburst simulation apparatus.

Referring to FIG. 1, the airburst simulation apparatus may be implemented as a personal firearm having a dual barrel 1. The personal firearm having a dual barrel 1 may include an airburst ammunition barrel 5, a bullet barrel 4, a fire control system 3, a trigger 11, a laser emitting device 18, and a rifle 2.

An obstacle behind which a target is hidden may be detected through a scope (not shown) of the fire control system 3, and a range up to the obstacle may be measured by operating a laser emitting button 12, which is cooperative with a laser range finder (not shown) disposed within the fire control system 3. A distance up to the target may be adjusted using range varying buttons 13 and 14, by taking a thickness of the obstacle into account.

The personal firearm having a dual barrel 1 may select a bullet and an airburst ammunition. For example, when the airburst ammunition is selected, a fuse mode setting button 15 may be used to select one of airburst, point detonation or point delayed detonation as the fuse mode. The point detonation indicates that an explosive shell (bombshell, explosive bullet) is detonated (exploded) by impact at the moment when a target arrives, and the point delayed detonation indicates that the explosive shell penetrates through an obstacle and is detonated after a preset time elapses when a target is hidden behind an obstacle. The airburst indicates that the explosive shell is detonated above a target.

The airburst simulation apparatus may further include a laser emitter 7, a fire control system interface wire 8, an airburst simulated ammunition (or airburst dummy ammunition) 9, and a simulated ammunition interface wire 10. Also, the airburst simulation apparatus may include a fire control system interface 25, and a simulated ammunition interface 26, and further include at least one of a firing (shooting) noise generator 29, and a firing impact detector 28. Also, a power supply 27 for supplying power to the laser emitter 7 may be installed in the airburst simulation apparatus.

Referring to FIG. 1, the laser emitter 7 may be installed on the personal firearm having a dual barrel 1. A laser (or laser beam) may be emitted (fired, shot) instead of the airburst ammunition. Hence, the laser emitter 7 may preferably be installed near an airburst ammunition barrel (air explosive bomb barrel, air explosive shell barrel, airburst bomb barrel). That is, the laser emitter 7 may be arranged such that laser beam is emitted in the same direction as the airburst ammunition barrel 5 firing the airburst ammunition.

The laser emitter 7 may emit laser beam by detecting pressure applied onto the airburst simulated ammunition 9 as the trigger 11 is pulled. Thus, whether or not the laser beam has been emitted may be determined based on the airburst simulated ammunition 9.

Referring to FIG. 1 and FIGS. 3A to 3C, upon pulling the trigger 11, a hammer 17 connected to the trigger 11 may be released from a rotation-restricted state. Accordingly, the hammer 17 may rotate to hit a firing pin 16. The firing pin 16 may thus move forward to apply pressure to a pressure sensor of the simulated ammunition 9.

The pressure sensor may generate a signal in response to the pressure, and the signal may be transmitted to the laser emitter 7 via the simulated ammunition interface wire 10. The signal may be transferred to the laser emitting device 18 via a code converter 24, accordingly, the laser emitting device 18 may emit the laser beam.

Here, unlike the accompanying drawings, the simulated ammunition 9 may be replaced with a blank cartridge. The firing impact detector 28 may detect an impact when the blank cartridge is fired, and accordingly laser beam may be emitted.

Referring to FIGS. 5A and 5B and FIGS. 6A and 6B, the airburst simulation apparatus may further include a Global Positioning System (GPS) 20, an electronic compass 21, and a wireless transceiver 22. The electronic compass 21 may include a 2-axis magnetic sensor, a tilt sensor, or a 3-axis magnetic sensor. Therefore, the electronic compass 21 may measure an azimuth ($\phi$) as a rotational angle from the true north of a laser optic axis, and an elevation ($\theta$) as a tilt angle from the ground.

When the laser beam is emitted, a fire controller 19 may calculate GPS coordinates ($P_t=(X_t,Y_t,Z_t)$) of an airburst aiming position. The GPS coordinates ($P_t=(X_t,Y_t,Z_t)$) of the airburst aiming position may be obtained based on a three-dimensional (3D) directional vector ($\vec{d_s}=(x_s,y_s,z_s)$) of a laser beam that the electronic compass 21 measures, GPS coordinates ($P_s=(X_s,Y_s,Z_s)$) of a laser emission position measured by the GPS 20 mounted in the laser emitter 7, and range information measured by the laser range finder.

The GPS coordinates ($P_t=(X_t,Y_t,Z_t)$) of the airburst aiming position, the 3D directional vector ($\vec{d_s}=(x_s,y_s,z_s)$) of the laser beam, the GPS coordinates ($P_s=(X_s,Y_s,Z_s)$) of the laser emission position, the range information and an Identification Number (ID) relating to the laser emitter 7 may be transmitted to a training control center via the wireless transceiver 22.

When the target is located in a GPS reception poor area, such as the inside of a building, the GPS 20 may be replaced with an indoor location tracking unit 23.

The indoor location tracking unit 23 may include at least one of various sensors, for example, a gyro sensor, an acceleration sensor, an ultrasonic sensor and a radio frequency (RF) sensor. The indoor location tracking unit 23 may thus track a moving path of a soldier using the sensor. That is, when the soldier is located within a building, a sensor may be installed at a specific location, of which GPS coordinates are aware, within the building. Accordingly, when the soldier passes the specific location, the sensor may sense the soldier's location. This may allow for compensation for the soldier's 3D GPS coordinates.

FIG. 4 is a flowchart showing sequential operation steps of a firing simulation system for an airburst using the airburst simulation apparatus.

Referring to FIGS. 4A and 4B, a target is hidden behind an obstacle, for example, behind a wall or inside a trench. A laser aiming marker A may match a laser aiming position T, namely, the obstacle where the target is hidden.

Referring to FIGS. 4C and 4D, the laser range finder may operate to measure a distance up to the obstacle, and control (adjust, compensate for) a range using the range varying buttons 13 and 14, taking into account a spaced distance between the target and the obstacle behind the obstacle and a thickness of the obstacle. Here, an optic axis of the laser beam emitted from the laser range finder may be arranged to match an optic axis of laser beam fired from the laser emitter 7.

Range information, a type of ammunition and a fuse mode may be transmitted to the laser emitter 7 via the fire control system interface wire 8, which is connected to an external connection hole 6 located on a right surface of the fire control system 3.

Referring to FIGS. 4E and 4F, an aiming point marker R, based on the trajectory calculation by the fire control system 3, may be displayed on the scope of the fire control system 3. Here, the aiming point marker R is a value to which a trajectory in a parabolic form by the gravity is reflected. Therefore, upon emitting the laser beam with the straight propagation property, the laser aiming marker A may be used for firing. The laser beam may thusly be emitted toward the laser aiming marker A.

Hereinafter, description will be given of a detecting unit for detecting the emitted laser beam and a determining unit for determining whether or not a target has been shot. The detecting unit and the determining unit may be implemented by the laser detector 30.

Figure 7:
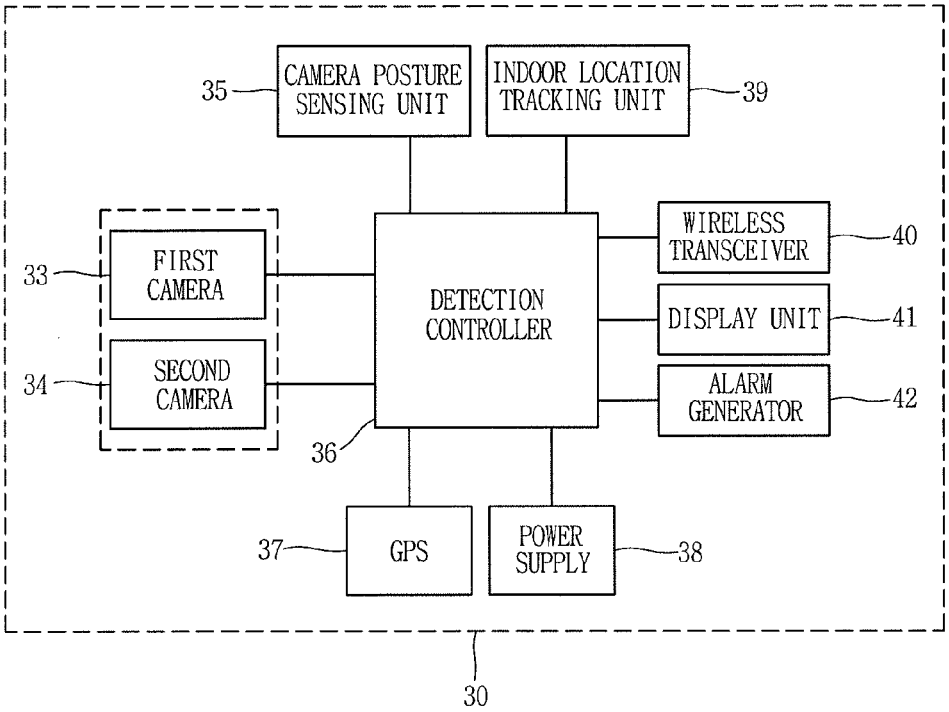
FIG. 7 is a configuration view of a laser detector.
Figure 8:
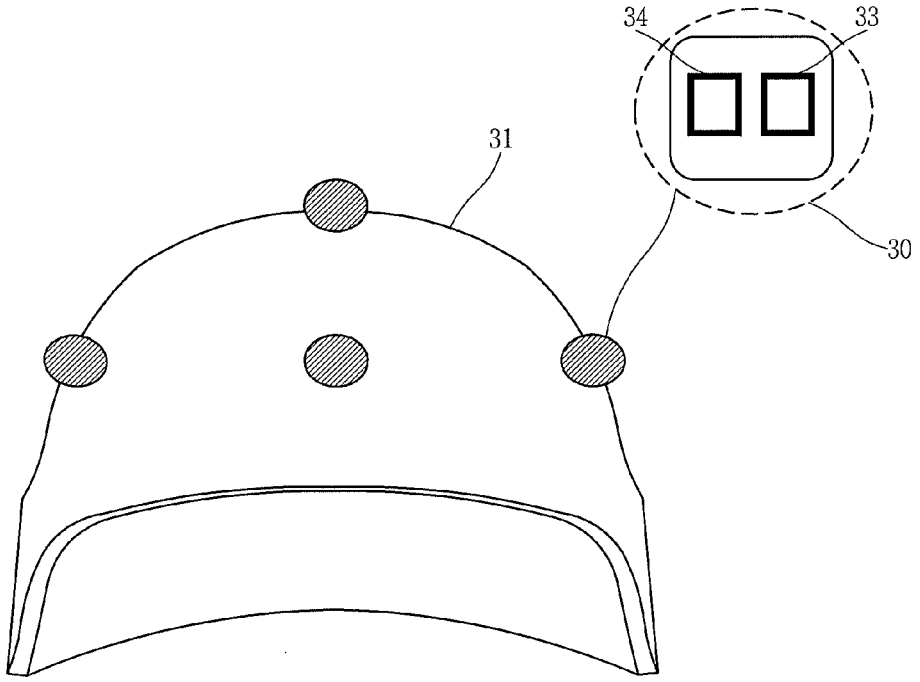
FIG. 8 is a conceptual view of a helmet having the laser detector.

FIG. 7 is a configuration view of a laser detector, and FIG. 8 is a conceptual view of a helmet having the laser detector.

Referring to FIG. 7, the laser detector 30 may include first and second cameras 33 and 34, a GPS 37, a camera posture sensing unit 35, a display unit 41, an alarm generating unit 42, a power supply 38 and a detection controller 36.

Referring to FIG. 8, the laser detector 30 may be mounted, for example, to a helmet 31 of a target. The laser detector 30 may preferably be arranged on a top of the helmet 31 and in a circumferential direction of the helmet 31 so as to detect an overall region around the helmet 31. Unlike this arrangement, the laser detector 30 may be installed in a combat uniform of a target, and the installation position may not be limited to preset position.

Each of the first and second cameras 33 and 34 may have, if necessary, an infrared filter for sensing laser beam which passes over the laser detector 30. The first and second cameras 33 and 34 may be spaced apart from each other to photograph (take) the laser beam into stereo images. Therefore, 3D relative coordinates of the laser beam may be calculated based on a distance up to the photographed laser beam and positions that the first and second cameras 33 and 34 are mounted on the target, respectively.

That is, when the emitted laser beam passes over the laser detector 30 that a target hidden behind the obstacle is wearing, it is photographed into the stereo image.

To recognize orientation angles of the first and second cameras 33 and 34, the camera posture sensing unit 35 may be installed. For example, the camera posture sensing unit 35 may include a gyro sensor.

The GPS 37 may allow for recognizing a current position of the laser detector 30 using electric waves transmitted from a satellite. That is, the GPS 37 may allow for identifying a position of the target, to measure a distance between the actual position of the target and the airburst aiming position. Accordingly, whether or not the target is to be shot by the laser beam may be determined on the basis as to whether the airburst aiming position is close to the actual position of the target. That is, the actual position of the target obtained by use of the GPS 37 may be compared with the airburst aiming position to determine whether the airburst aiming position has precisely been set, and a distance between the airburst aiming position and a laser arrival position detected by the laser detector 30 after the laser beam arrives may be calculated to determine whether or not the calculated distance is within a preset distance. Such determinations may allow for determining whether or not the target has been shot.

The display unit 41 may include an display window (not shown) which exhibits whether or not the target has been shot. This is to show whether or not a soldier who is carrying out a simulated engagement has been shot by another soldier.

When the target has successfully been shot, the alarm generating unit 42 may generate an alarm sound to allow the successful firing to be identified from far away. The detection controller 36 may control operations of the first and second cameras 33 and 34, the camera posture sensing unit 35, the GPS 37 and the display unit 41.

That is, in view of the characteristic of laser beam with the straight propagation property, the laser beam within the images captured by the first and second cameras 33 and 34 may be displayed with a segment. 3D GPS coordinates of both end points of the segment may be obtained using the GPS coordinates ($P_r=(X_r,Y_r,Z_r)$) of the target and the orientation angle of the posture sensing unit 35. Also, a 3D directional vector ($\vec{d}_s(x_s,y_s,z_s)$) of the detected laser beam may be obtained using the 3D GPS coordinates of the both ends of the segment.

The GPS coordinates ($P_r=(X_r,Y_r,Z_r)$) of the target, the 3D directional vector ($\vec{d}_s(x_s,y_s,z_s)$) of the laser beam and information (ID) relating to the laser detector 30 may be wirelessly transmitted in real time to the training control center via the wireless transceiver 40.

Here, when the target is located in a GPS reception poor area, such as the inside of a building, an indoor location tracking unit 39 may replace the GPS 37. The indoor location tracking unit 39 may be implemented substantially in the same manner as the indoor position tracking unit 23 installed in the laser emitter 7. Therefore, the implementation method of the indoor position tracking unit 39 may be understood by the description of indoor position tracking unit 23 in the laser emitter 7, so detailed description thereof will be omitted.

The power supply 38 may supply power necessary to drive the laser detector 30.

When the same soldier wears both the laser emitter 7 and the laser detector 30, only one of the GPS 20, 37 and the indoor position tracking unit 23, 39 may be installed according to whether or not a region is tracked by GPS. Also, the GPS 20, 37, the indoor location tracking unit 23, 39, the power supply 27, 38 and the wireless transceiver 22, 40 may be integrated into a common module, to be installed in the laser emitter 7 and the laser detector 30.

In case of a simulated engagement that soldiers emit (shoot, fire) laser beams simultaneously, it may be necessary to check which soldier emitted a laser beam which has been detected (sensed). Therefore, a primary sorting may be carried out with respect to laser emission information, which is received for a preset time ($t_r-\Delta\leq t\leq t_r$), starting from a time point ($t=t_r$) that the training control center has received laser detection information.

Laser directional vectors ($\vec{d}_i$, i=1, . . . n) of those primarily sorted laser emission information may be compared with laser directional vector ($\vec{d}_s=(x_s,y_s,z_s)$) of the laser detection information, thereby secondarily sorting emission information relating to laser beam whose parallelism is checked within a preset error range.

Of those secondarily sorted laser emission information, GPS coordinates ($P_r=(X_r,Y_r,Z_r)$) of the target having the laser detector 30 may be compared with GPS coordinates ($P_t=(X_t,Y_t,Z_t)$) of airburst aiming position to which the soldiers have shot the laser beams. When a distance between the two positions are within a preset distance (L), it may be determined that the target has been shot. The preset distance (L) may be set by taking into account an error between the GPS coordinates of the target and the GPS coordinates of the soldier and a casualty radius of the airburst ammunition.

When the training control center transmits the firing results to the target in a wireless manner, the wireless transceiver 40 of the laser detector 30 may receive the results and exhibit the results on the display unit 41. Also, the alarm generating unit 42 may generate the alarm sound.

Also, the detection controller 36 of the laser detector 30 may record the number of firing carried out by each soldier. For example, when a solider exceeds a preset number of firing, the soldier may be unable to fire (emit) a laser beam any more even if he pulls the trigger 11.

The training control center may also check the number of firing carried out by each soldier. Accordingly, laser beams, which have been detected by the laser detector 30 as exceeding the preset number of firing, may be determined as not hit.

In addition, by use of the GPS coordinates ($P_t=(X_t,Y_t,Z_t)$) airburst aiming position which are obtained by the laser emitter 7, the airburst ammunition may be controlled to be exploded at the GPS coordinates ($P_t=(X_t,Y_t,Z_t)$) of the airburst aiming position on a program of the training control center. This may allow an effect of hitting the target to be shown directly on the program of the training control center.

The configurations and methods of the airburst simulation apparatus in the aforesaid embodiments may not be limitedly applied, but such embodiments may be configured by a selective combination of all or part of the embodiments so as to implement many variations.

With the configuration, an airburst, by which a target hidden behind an obstacle is shot, may be simulated by using the airburst simulation apparatus.

Also, with first and second cameras, a GPS, an electronic compass or an indoor location tracking unit, an airburst aiming position and a detection position of a laser beam may be precisely recognized, thereby determining whether or not the target has been shot.

In addition, the use of noise generating unit or a blank cartridge may allow the simulation to be similar to an actual situation.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An airburst simulation system comprising:

a laser range finder emitting laser beam having an optic axis, the laser range finder configured to measure a distance up to a target;

range varying buttons configured for adjusting a range;

a laser emitting unit configured for receiving information of the range and emitting a laser beam to an airburst aiming position, preset above a target hidden behind an obstacle, such that a warhead is airbursted to shoot the target, wherein an optic axis of the laser beam from the laser emitting unit is arranged to match the optic axis of a laser beam from the laser range finder;

a laser detecting unit mounted onto the target to detect an arrival of the laser beam above the target; and a determining unit to measure a distance between the airburst aiming position and an arrival position of the laser detected by the laser detecting unit, and determine whether or not the target has been shot based on the distance.

2. The system of claim 1, wherein the laser emitting unit comprises:

a body of a weapon having a trigger; and a laser emitter installed in the body to emit laser beam by pulling the trigger.

3. The system of claim 2, wherein the laser emitting unit comprises:

a firing pin protruded by the trigger to press a simulated ammunition; and a pressure sensor to sense pressure applied onto the simulated ammunition, and convert the sensed pressure into a signal to transfer to the laser emitting unit.

4. The system of claim 3, wherein the laser emitting unit further comprises a firing noise generator to generate noise upon emitting the laser beam.

5. The system of claim 2, wherein the laser emitting unit comprises:

a blank cartridge fired by the trigger; and a firing impact detector to detect the firing of the blank cartridge.

6. The system of claim 2, wherein the laser emitting unit comprises:

a Global Positioning System (GPS); and an electronic compass.

7. The system of claim 1, wherein the laser detecting unit comprises:

first and second cameras disposed with being spaced apart from each other to photograph the laser beam, respectively, at the spaced positions; and a posture sensing unit to measure respective angles that the first and second cameras face the laser.

8. The system of claim 1, wherein the determining unit measures the distance between the airburst aiming position and the arrival position of the detected laser, to determine whether or not the target has been shot based on the measured distance and a preset reference distance.

9. The system of claim 8, wherein the determining unit comprises a display unit to output at least one of an image and a sound to indicate whether or not the target has been shot.

10. The system of claim 1, wherein when the laser emitting unit emits a plurality of laser beams, the determining unit determines which laser beam of the plurality of laser beams has shot the target, by comparison between a time point of sensing the arrival of the laser beam and a time point of emitting the laser beam, comparison between coordinates of a position of the target and coordinates of the airburst aiming position, and comparison between a directional vector of the emitted laser beam and a directional vector of the laser beam detected by the laser detecting unit.

11. The system of claim 1, wherein the available number of laser emission by the laser emitting unit is limited to a preset number of times, and wherein the determining unit determines a laser beam, which is emitted after exceeding the preset number of times, to be invalid.

12. A simulation method for an airburst comprising the steps of:

emitting a laser beam having an optic axis to measure a distance up to a target;

adjusting a range, by range varying buttons;

receiving information of the range;

emitting a laser beam to an airburst aiming position, preset above a target hidden behind an obstacle, such that a warhead is airbursted to shoot the target, wherein an optic axis of the laser beam from the laser emitting unit is arranged to match an optic axis of laser beam from the laser range finder;

detecting the laser beam arriving above the target; and measuring a distance between the airburst aiming position and an arrival position of the laser beam, and determining whether or not the target has been shot based on the distance.

13. The method of claim 12, wherein the step of emitting the laser beam to the airburst aiming position, preset above the target hidden behind an obstacle, such that the warhead is airbursted to shoot the target comprises:

applying pressure to a simulated ammunition by pulling a trigger;

generating a signal by sensing the pressure applied to the simulated ammunition; and emitting the laser beam in response to the signal.

14. The method of claim 13, wherein the step of emitting the laser beam to the airburst aiming position comprises:

measuring a distance from a position of emitting the laser beam to the obstacle, so as to estimate a distance up to the target.

* * * * *